US005529223A

United States Patent [19]

Fisher

[11] Patent Number: 5,529,223

[45] Date of Patent: Jun. 25, 1996

[54] WASH BOTTLES

[75] Inventor: Luke Fisher, Stone, United Kingdom

[73] Assignee: Bibby Sterilin Limited, London, England

[21] Appl. No.: 346,116

[22] Filed: Nov. 29, 1994

[30] Foreign Application Priority Data

Jan. 7, 1994 [GB] United Kingdom ..... 9400221

[51] Int. Cl.[6] ..... B65D 37/00

[52] U.S. Cl. ..... 222/211; 222/481.5

[58] Field of Search ..... 222/211, 212, 222/481.5, 464.1, 108, 109

[56] References Cited

U.S. PATENT DOCUMENTS

| | | | |
|---|---|---|---|
| 3,162,333 | 12/1964 | Davidson | 222/211 |
| 4,557,401 | 12/1985 | Hodge | 222/211 |
| 4,836,422 | 6/1989 | Rosenberg | 222/212 |
| 5,125,543 | 6/1992 | Rohrabacher et al. | 222/211 |
| 5,251,792 | 10/1993 | Sheen | 222/211 |

FOREIGN PATENT DOCUMENTS 935485 8/1963 United Kingdom .

OTHER PUBLICATIONS

Vrouvas, Leakproof Laboratory Wash Bottle, Jun. 1967, p. 50, vol. 10, No. 1.

*Primary Examiner*—Andres Kashnikow
*Assistant Examiner*—Philippe Derakshani
*Attorney, Agent, or Firm*—Seidel Gonda Lavorgna & Monaco

[57] ABSTRACT

A wash bottle for dispensing solvent comprises a squeezable plastics container with a cap. A syphon tube extends from near the bottom of the container to a nozzle extending through the cap. As a continuation of the syphon tube is a valve body, whereby pressure above the solvent can be relieved and which closes when the bottle is squeezed for solvent to be dispensed via the syphon tube and nozzle.

2 Claims, 3 Drawing Sheets

WASH BOTTLES

FIELD OF THE INVENTION

This invention concerns improvements in and relating to wash bottles.

BACKGROUND OF THE INVENTION

The use of volatile solvents, such as acetone, has long been made an easy and everyday task by the advent of the plastic wash bottle. Such wash bottles have a squeezable container with a syphon tube from near the bottom of the container to transfer liquid through a nozzle connected to the syphon tube when the bottle is squeezed. However, such wash bottles with leak proof screw caps drip volatile solvents particularly in warm rooms due to build up of vapour pressure within the bottle.

An object of this invention is to provide a wash bottle that substantially eliminates undesired internal pressures and drip formation.

SUMMARY OF THE INVENTION

According to this invention there is provided a wash bottle comprising a squeezable plastics container and a syphon tube within the container and leading to a nozzle extending out of the container, characterised by a valve in a wall of said tube for pressure equalisation above liquid in the bottle in its normal state, which valve closes when the bottle is squeezed to urge liquid through the syphon tube.

The valve preferably comprises a valve chamber open to the bottle cavity at one side and having an aperture at its other end leading to the syphon tube which is closable by a valve member, such as a ball. The aperture may have a periphery shaped to receive the ball. Thus, when the bottle is squeezed, the pressure of gases in the bottle will close the valve so that the liquid will be dispensed from the nozzle of the bottle.

When the wash bottle is not in use, the valve will remain open so that any build up of vapour pressure in the bottle can be vented through the valve and the nozzle of the bottle.

Thus, vapour pressure build up may be avoided without allowing liquid to pass, so that dripping can be avoided.

BRIEF DESCRIPTION OF THE DRAWINGS

The invention will now be further described, by way of example only, in which.

DETAILED DESCRIPTION OF THE INVENTION

Figure 1:
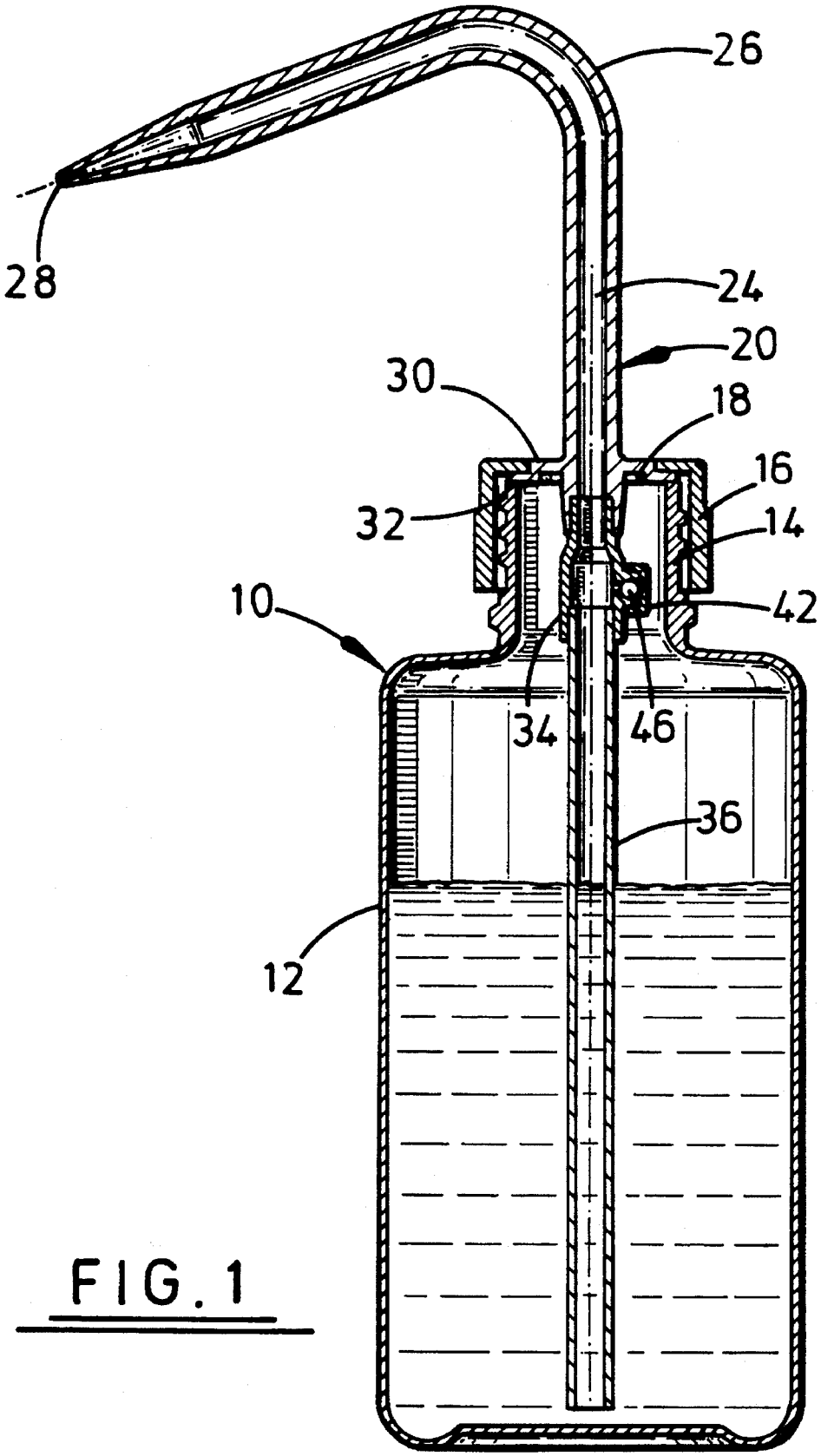
FIG. 1 is a section through a wash bottle.
Figure 2:
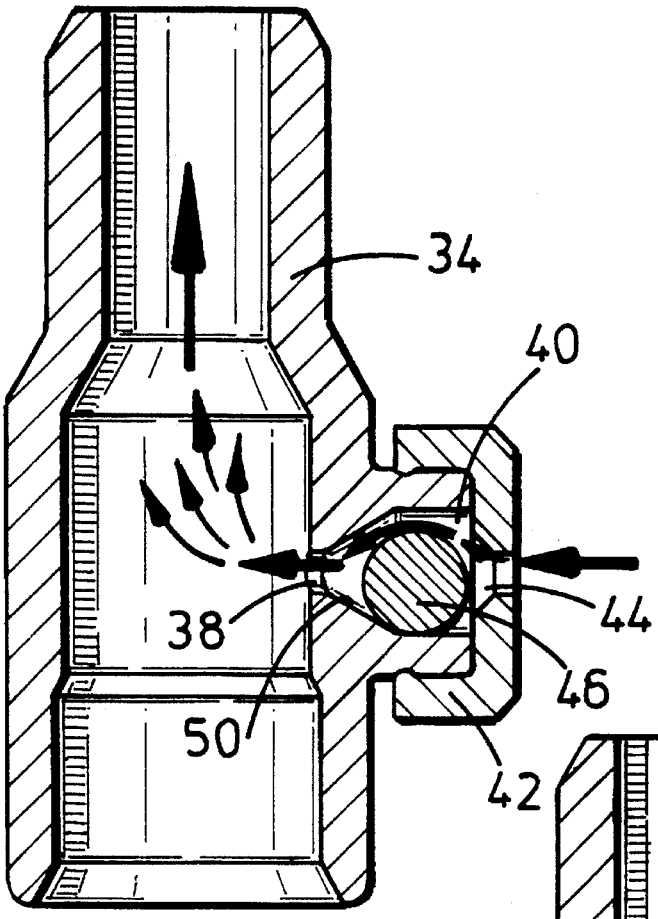
FIG. 2 is a section through detail of the wash bottle of FIG. 1.
Figure 3:
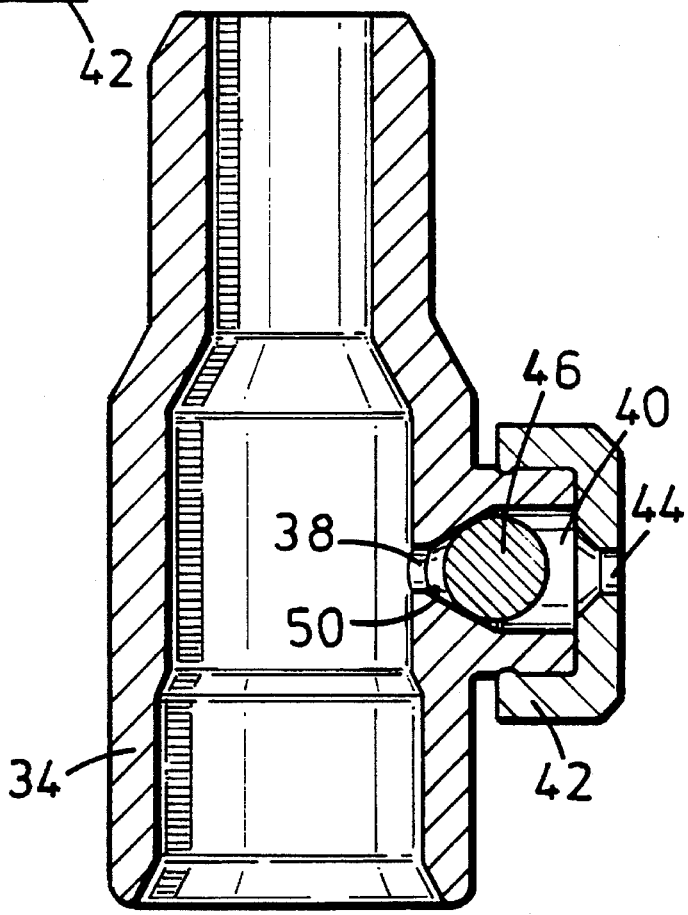
FIG. 3 is a section through the same detail of the wash bottle of FIG. 1 when the bottle is being squeezed.

Referring to FIGS. 1 to 3 of the accompanying drawings, a wash bottle 10 containing a liquid, comprises a squeezable plastics container 12 having neck 14 and a cap 16 which is a screw fit onto the neck 14. The cap 16 has an opening 18 in its top surface to accommodate a nozzle 20.

The nozzle 20 comprises a tube 24 bent at 26 so that when the bottle is upright, the outlet end 28 of the tube points slightly downwards. The tube 24 converges to form the narrower outlet end 28. Near its other end the tube 24 has a stepped circular flange 30 on its outer surface. The flange 30 locates in the opening 18 of the cap 16 with its outer stepped portion 32 trapped between the cap and the neck of the bottle.

The nozzle 20 is connected at its end in the bottle to a valve body 34 which is in turn connected to a syphon tube 36, whereby when the bottle is squeezed liquid in the bottle is forced through the syphon tube 36, the valve body 34 and the nozzle 20 out of the bottle.

The valve body 34 has a hole 38 with divergent sides 50 in its side wall leading to a valve chamber 40 of generally circular section. The divergent sides 50 provide a valve seat for a ball 46 in the valve chamber 40. The valve chamber 40 has a snap-fit cover 42 on its outer end and the cover 42 has an opening 44 therein.

When the bottle is squeezed (see FIG. 3), the ball 46 is urged into the valve seat 50 by the pressure of gases in the bottle. The pressure also forces the liquid in the container up the syphon tube 36, through the valve body 34 and out through the nozzle 20. When squeezing pressure on the bottle is released, the ball 46 unseats from the valve seat 50 leaving a passageway through the valve chamber 40 via hole 38 and opening 44 (see FIG. 2), so that pressure within the bottle above liquid therein can equalise with atmospheric pressure. Thus, low pressure vapours can escape through the nozzle without allowing liquid to pass, preventing dripping while the bottle is not in use.

Figure 4:
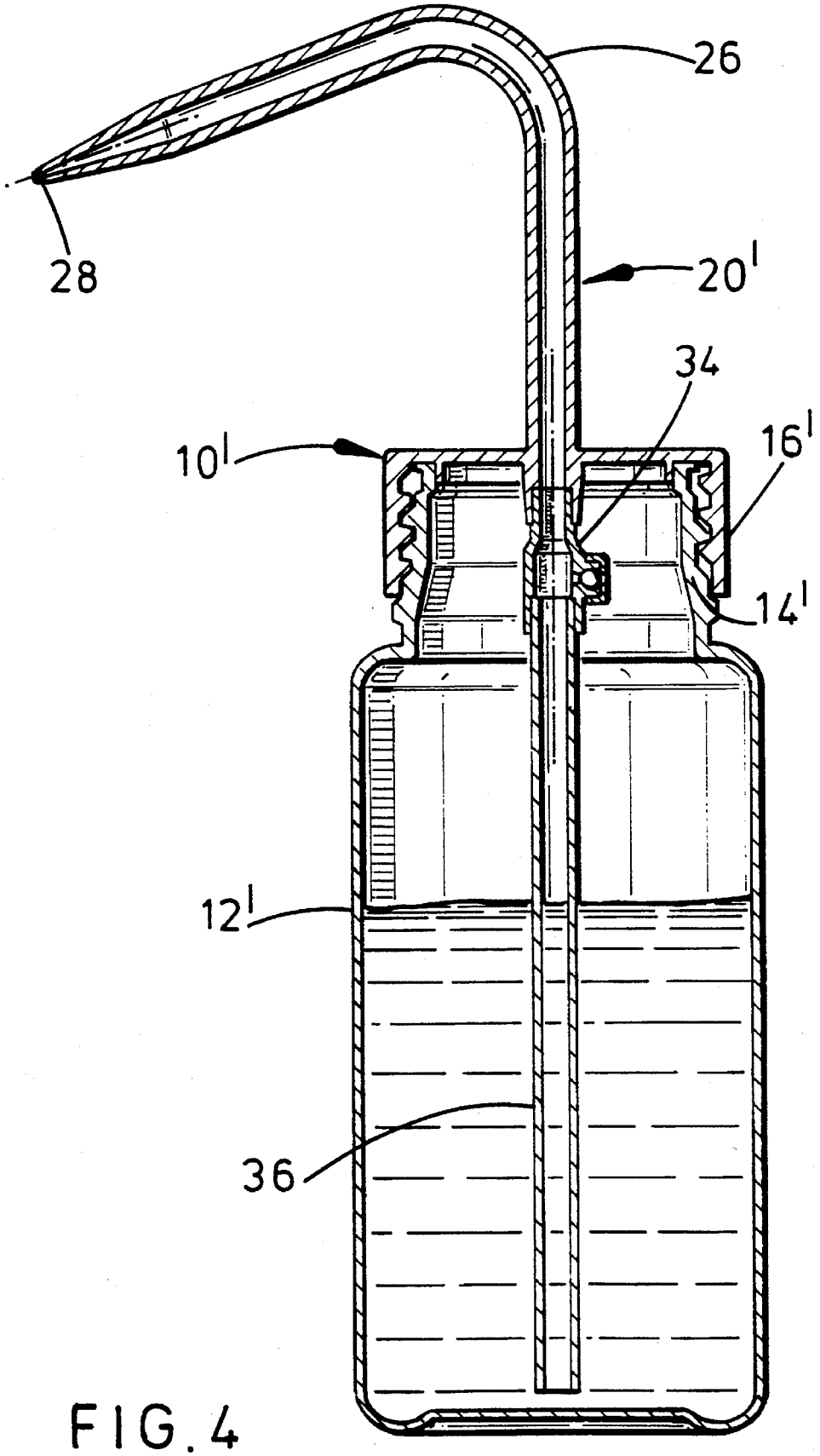
FIG. 4 shows another embodiment of the invention.

Referring to FIG. 4 of the accompanying drawings an alternative wash bottle 10' is shown. Like parts to the wash bottle of FIGS. 1 to 3 have been given the same reference numerals and will not be described again. Operation of the wash bottle 10' is the same as for bottle 10 and again will not be described. The difference between the wash bottles 10 and 10' resides in the form of the cap and nozzle arrangement. The wash bottle 10' has a wider neck 14' than the neck of the bottle 10 and instead of having a two-piece cap and nozzle, the cap and nozzle (16', 20') are formed in one piece. The cap part 16' has an inner depending ring 52 to fit inside the neck 14' of the bottle 12' to assist sealing of the cap on the neck.

I claim:

1. A wash bottle comprising a squeezable plastics container having a cap, a nozzle extending through the cap into the container, a generally vertical valve body having an upper end and a lower end, the nozzle communicating with the upper end of the valve body, a syphon tube extending from a lower end of the valve body, a generally horizontal valve chamber intermediate the ends of the valve body and extending from one side thereof, the valve chamber having a wall forming a main part having a floor and containing a ball having a radius, an opening at one end converging towards and communicating with the valve body and an opening at its other end communicating with the container, each opening having a central axis spaced from the floor of the main part by a distance greater than the radius of the ball, whereby the ball sits on the floor of the valve chamber to allow pressure equalisation above liquid in the container in its normal state and closes the opening to the valve body when the bottle is squeezed to urge liquid through the syphon tube.

2. A wash bottle as claimed in claim 1, characterised in that the valve chamber has a snap-on cover forming its end open to the container.

* * * * *